United States Patent [19]

Gerhardy et al.

[11] Patent Number: 4,861,522

[45] Date of Patent: Aug. 29, 1989

[54] CARBURETOR FOR AN INTERNAL COMBUSTION ENGINE

[75] Inventors: Reinhard Gerhardy, Korb; Hans Holderle, Freiberg; Jürgen Wolf, Stuttgart; Werner Vonderau, Backnang, all of Fed. Rep. of Germany

[73] Assignee: Andreas Stihl, Waiblingen, Fed. Rep. of Germany

[21] Appl. No.: 189,129

[22] Filed: May 2, 1988

[30] Foreign Application Priority Data

May 8, 1987 [DE] Fed. Rep. of Germany ..... 3715272

[51] Int. Cl.[4] ..... F02M 7/22

[52] U.S. Cl. ..... 261/35; 261/DIG. 6 X; 261/51; 261/67; 137/625.44

[58] Field of Search ..... 261/DIG. 68, 51, 67, 261/35; 137/625.44

[56] References Cited

U.S. PATENT DOCUMENTS

| | | | |
|---|---|---|---|
| 1,265,807 | 5/1918 | Moe | 137/625.44 |
| 2,035,747 | 3/1936 | Harris | 137/625.44 |
| 2,261,794 | 11/1941 | Carlson et al. | 261/50.1 |
| 2,368,120 | 1/1945 | Downey | 137/625.44 |
| 2,918,046 | 12/1959 | Teagarden | 261/DIG. 68 |
| 3,670,706 | 6/1972 | Fujisawa | 261/51 |
| 3,983,850 | 10/1976 | Stumpp et al. | 261/51 |

*Primary Examiner*—Tim Miles

*Attorney, Agent, or Firm*—Walter Ottesen

[57] ABSTRACT

Disturbances can occur in handheld portable tools driven by internal combustion engines because the idle-nozzle system and the main-nozzle system influence each other. The carburetor of the invention prevents this disturbing influence and provides a control of the engine which is proportional to speed. The carburetor includes a control member which closes off the main nozzle during idle operation and the idle nozzle during operation under load in dependence upon the position of the throttle flap.

10 Claims, 5 Drawing Sheets

CARBURETOR FOR AN INTERNAL COMBUSTION ENGINE

FIELD OF THE INVENTION

The invention relates to a carburetor for the engine of a handheld apparatus such as a chain saw. The carburetor has a throttle flap for changing the rotational speed of the engine as well as an idle nozzle for idle operation and a main nozzle for the operation of the engine under load.

BACKGROUND OF THE INVENTION

The carburetors utilized for handheld chain saws and similar tools have an idle-nozzle system and a main nozzle system. These two nozzle systems are both charged with fuel from a membrane chamber and have a certain functional relationship and each influences the other at least in part. A one-way valve is provided in the main nozzle and is configured as a check valve. It is a disadvantage that this one-way valve does not close without difficulty during no-load operations, for example, because of oscillations in the chain saw so that undesired drops of fuel can leak out. The idle system is thereby disturbed by the main nozzle system. Since for operation under load, the idle system continues to operate in parallel to the main nozzle system, a further influence can occur so that no precise terminal rotational speed and optimal effective efficiency for full load can be guaranteed.

SUMMARY OF THE INVENTION

In view of the above, it is an object of the invention to provide a carburetor for a handheld apparatus driven by an internal combustion engine. The apparatus can, for example, be a motor-driven chain saw.

The carburetor according to the invention includes: a housing defining an intake passage communicating with the engine and through which a stream of air is drawn by suction when the engine is operating; an adjustable throttle flap pivotally mounted in the intake passage for movement between an idle position and a load position corresponding to the idle operation and load operation, respectively, of the engine; idle-nozzle means for metering fuel into the intake passage during the idle operation of the engine; main-nozzle means for metering fuel into the intake passage during the load operation of the engine; a control member movable between a first position for closing the main-nozzle means during the idle operation and a second position for closing the idle-nozzle means during the load operation; and, connecting means for operatively connecting the throttle flap to the control member so as to cause the latter to be in the first position when the throttle flap is in the idle position and to move into the second position when the throttle flap is displaced into the load position.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
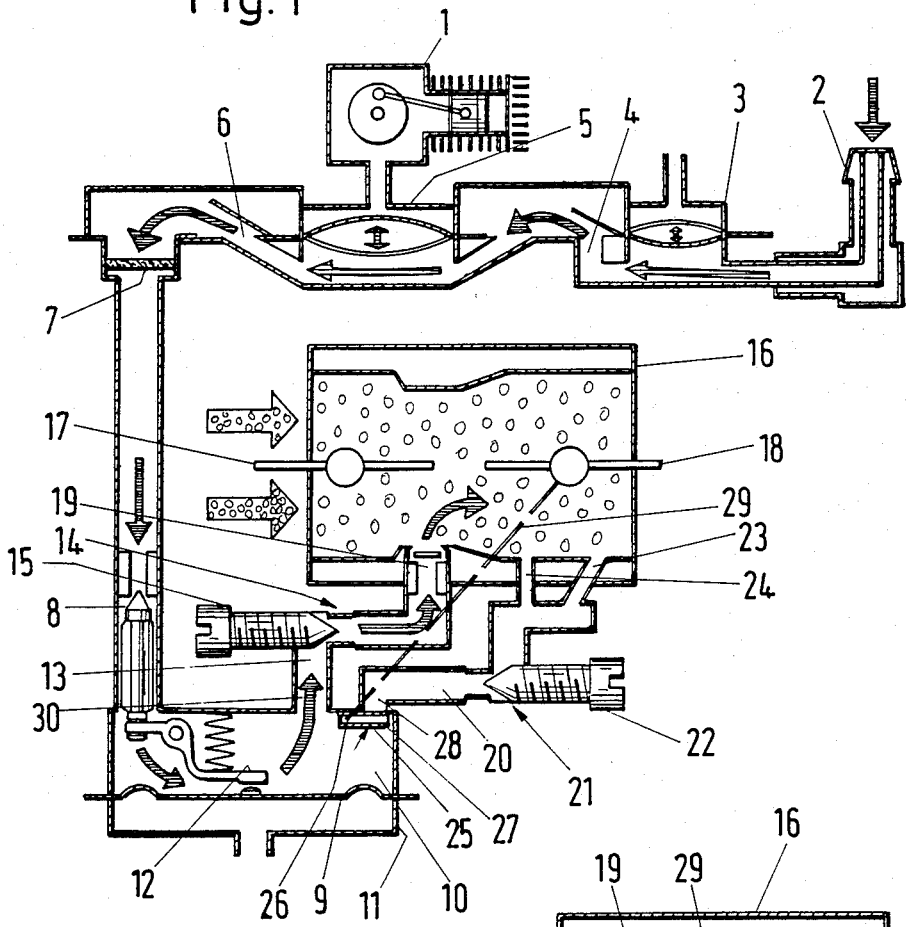
FIG. 1 is a schematic diagram showing the carburetor arrangement according to the invention for an internal combustion engine having a flap-like control member with the carburetor shown for the situation where the engine operates under full throttle.

Reference numeral 1 indicates the internal combustion engine provided for a chain saw or a similar handheld tool. The fuel for the engine 1 reaches an equalization vessel 3 via a feed line 2 and reaches the fuel pump 5 via an inlet valve 4. From here, the fuel is pumped through an outlet valve 6, the fine filter 7 and the feed valve 8 into a chamber 10 of the carburetor 11 which is bounded by a control membrane 9. The feed valve 8 for the fuel is controlled by the control membrane 9 via a spring-loaded control lever 12.

A main-nozzle channel 13 leads away from the chamber 10 of the carburetor 11 to an intake pipe 16 via a main nozzle 14 which is precisely adjustable by means of a control screw 15. In the intake pipe 16, a starter flap 17 and a throttle flap 18 are adjustably journalled by means of which the intake cross section can be changed. A check valve 19 is provided at the output of the main nozzle channel 13.

In addition, an idle-nozzle channel 20 leads from the chamber 10 of the carburetor 11 to the intake pipe 16 via an idle nozzle 21 which is adjustable by means of a control screw 22. The idle-nozzle channel 20 opens into an outlet bore 23. In addition, a bypass bore 24 is provided which opens into the idle-nozzle channel 20 from the intake pipe 16.

Figure 2:
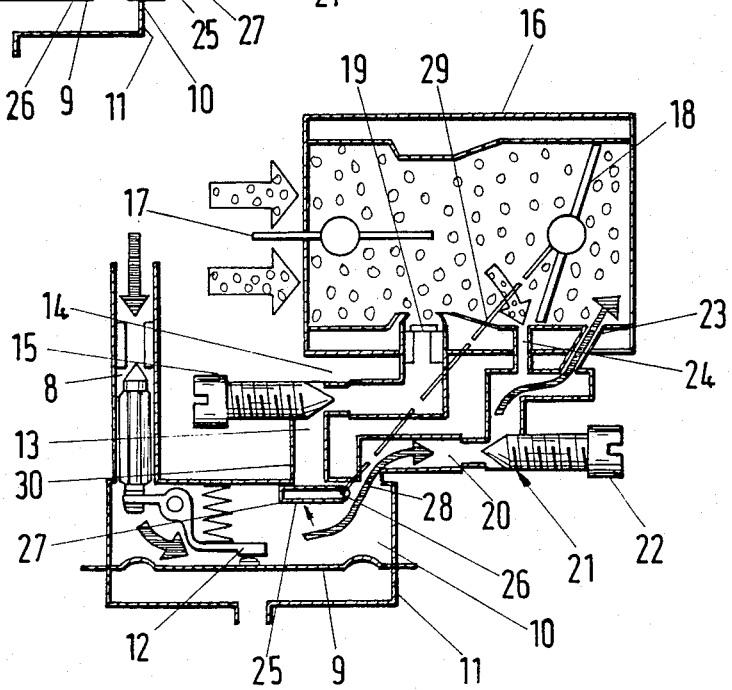
FIG. 2 shows the carburetor arrangement of FIG. 1 with the control member rotated about its pivot axis for the situation wherein the engine operates at idle.

The main nozzle 14 and the idle nozzle 21 are provided with a control member 25. In the embodiment of FIGS. 1 and 2, this control member 25 is configured as a closure flap 27 pivotable about an axis 26. The control member 25 is coupled to the throttle flap 18 by means of a connection 29. In FIG. 1, the control member 25 closes the inlet 28 of the idle-nozzle channel 20 facing toward the chamber 10 so that in the full-throttle position of the throttle flap shown, no fuel whatsoever can reach the intake pipe 16 via the idle nozzle 21. In this way, the fuel flows from the chamber 10 into the intake pipe 16 exclusively through the main-nozzle channel 13 via the main nozzle 14 and the check valve 19.

In FIG. 2, the throttle is released and the free cross section of the intake pipe 16 is substantially reduced by means of the throttle flap 18. The chain saw and its engine 1 operate at idle. By displacing the throttle flap 18 from full-load to idle, the control member 25 coupled via the connection 29 is pivoted through 180° about the axis 26 so that the input 30 of the main-nozzle channel 13 is now closed. For this reason, no fuel at all from chamber 10 can reach the intake pipe 16 at idle via the main nozzle 14. The fuel flows exclusively through the idle channel 20 via the idle nozzle 21 and the outlet bore 23 into the intake pipe 16 behind the throttle flap 18. The air necessary for the fuel mixture flows ahead of the blocked throttle flap 18 through the bypass bore 24 into the idle channel 20.

Figure 3:
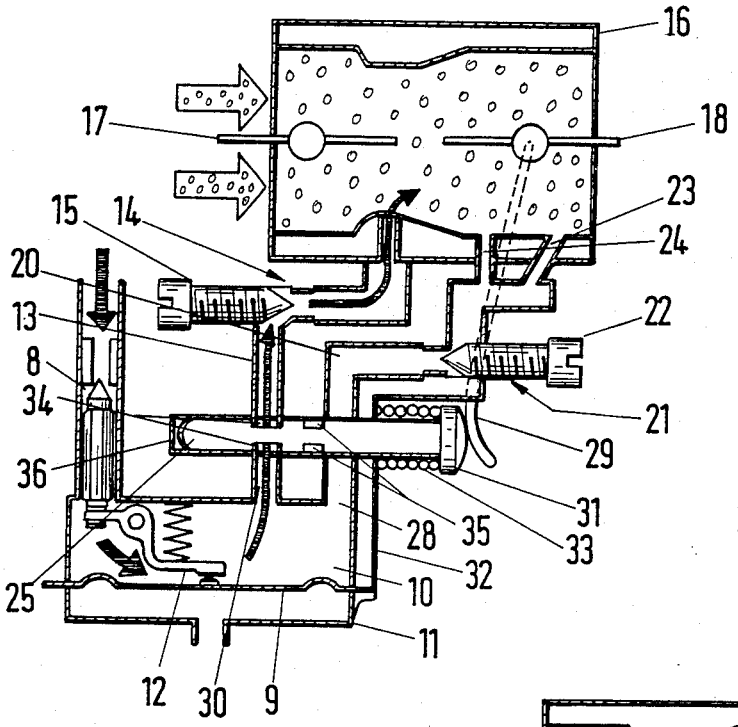
FIG. 3 is a carburetor arrangement similar to that shown in FIG. 1 and equipped with a bolt-like or piston-like control member at full-throttle.
Figure 4:
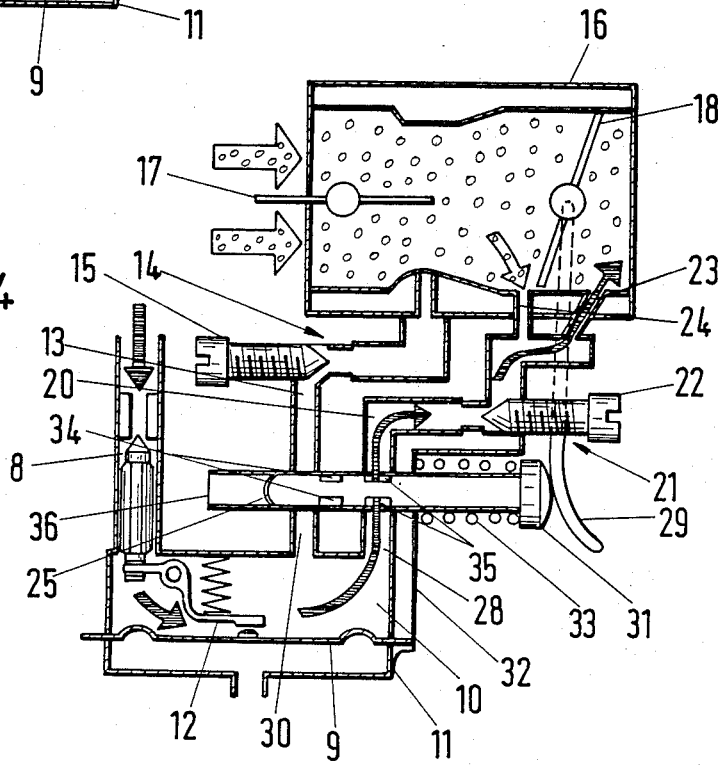
FIG. 4 shows the carburetor arrangement of FIG. 3 with the control member axially displaced for the condition wherein the engine runs at idle.

In the embodiment of FIGS. 3 and 4 another control member 25 is provided which can be preferably configured as an axial bolt displaceable in the direction of its longitudinal axis. FIG. 3 shows the position for full throttle whereas FIG. 4 shows the position for idle. The axial bolt-like control member 25 can have a head 31 and a preferably screw-shaped compression spring 33 can be provided between the head 31 and the wall 32 of the carburetor 11. The connection 29 lies against the head 31 of the control member 25. The axial bolt-shaped control member 25 includes cutouts or recesses (34, 35) which are provided for the through-flow of the fuel.

For the full-throttle position shown in FIG. 3, the control member 25 is pushed into housing bore 36 against the force of the compression spring 33 by means of the connection 29 coupled to the throttle flap 18 so far that the recesses 34 disposed a distance away from the head 31 are in the region of the main-nozzle channel 13; whereas, the recesses 35 lying closer to the head 31 are disposed outside of the idle-nozzle channel 20. In this position of the control member 25, the idle-nozzle channel 20 is thereby fully closed so that no fuel from chamber 10 can reach the intake pipe 16 via the idle nozzle 21. Rather, the fuel reaches the intake pipe 16 exclusively via the main-nozzle channel 13 through the recesses 34 and the main nozzle 14.

In FIG. 4, the engine 1 operates at idle. The throttle flap 18 then substantially blocks the cross section of the intake pipe 16. The connection 29 is displaced by the changed position of the throttle flap 18 compared to FIG. 3 and the axial bolt-like control member 25 is axially displaced (to the right) with the support of the compression spring 33. In this idle position, the main-nozzle channel 13 is closed since the recesses 34 are disposed outside of the main-nozzle channel 13. By contrast, the recesses 35 are now in the region of the idle-nozzle channel 20 so that the fuel now flows to the intake pipe 16 from chamber 10 through the idle-nozzle channel 20 via the recesses 35 and the idle nozzle 21.

Figure 5:
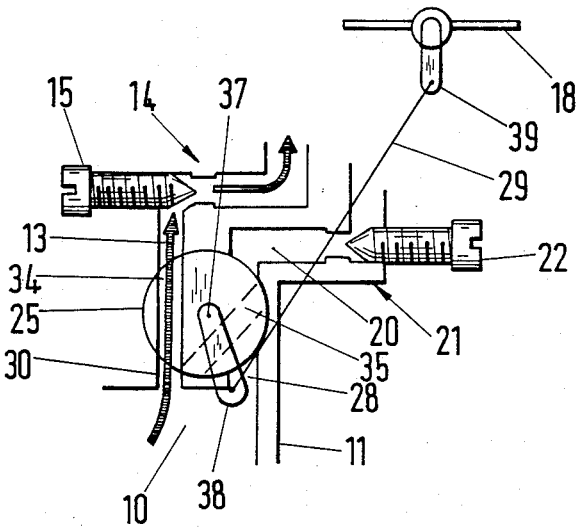
FIG. 5 shows a carburetor arrangement similar to that shown in FIG. 3 equipped with a control member mounted so as to be pivotable about its longitudinal axis and with the engine at full throttle.
Figure 6:
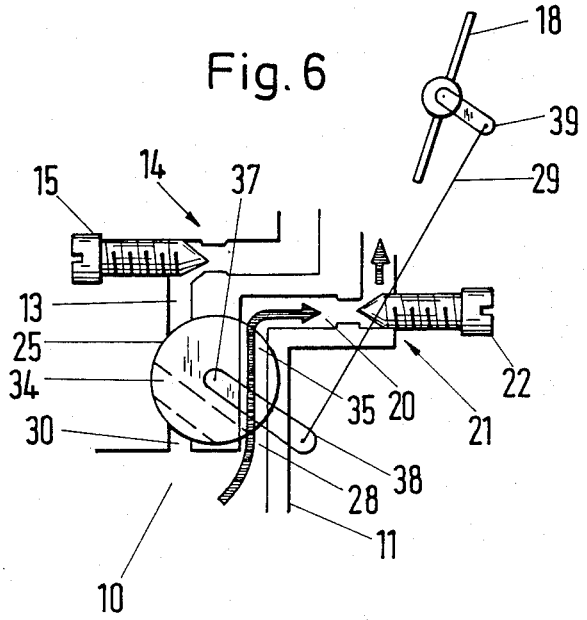
FIG. 6 shows the carburetor arrangement of FIG. 5 with the engine running at idle.

FIGS. 5 and 6 show that the axial bolt-shaped or piston-like control member 25 is journalled so as to be rotatable about its longitudinal axis 37. The recess 34 for the main-nozzle channel 13 and the recess 35 for the idle-nozzle channel 20 are disposed in the control member 25 so as to be at an angle with respect to each other.

The control member 25 has a radially extending lever 38 for rotating the same about the longitudinal axis 37. A radially extending lever 39 is likewise provided on the throttle flap 18. The two levers (38, 39) are coupled by the connection 29. At full throttle (FIG. 5) and when the throttle flap 18 is approximately in the horizontal position for opening the intake pipe 16, the control member 25 is in such a position that the recess 34 is precisely in alignment with the main-nozzle channel 13; whereas, the recess 35 extending diagonally thereto does not communicate with the idle-nozzle channel 20 so that the idle-nozzle channel 20 is fully blocked by the control member 25. In this way, the fuel reaches the intake pipe exclusively through the inlet 30, the recess 34, the main-nozzle channel 13 and the main nozzle 14.

At idle (FIG. 6) when the throttle flap 18 is positioned approximately vertically to reduce the intake cross section, the control member 25 is in such a position rotated about the longitudinal axis 37 because of the coupling via the connection 29 that the recess 35 is precisely aligned with the idle-nozzle channel 20; whereas, the recess 34 has no connection with the main-nozzle channel 13. Therefore, the main-nozzle channel 13 is fully closed in this position of the control member 25 so that no fuel can pass through the main-nozzle channel 13. The fuel flows in the direction of the intake pipe exclusively through the inlet 28, the recess 35, the idle-nozzle channel 20 and the idle nozzle 21.

Pursuant to a preferred embodiment of the invention, it can be especially desirable to combine the axial position (FIGS. 3 and 4) and the rotational displacement (FIGS. 5 and 6) of the control member 25 with each other. In an embodiment of this kind, it is advantageous that at full throttle only the main-nozzle channel 13 is open and the idle-nozzle channel 20 is closed (FIG. 3), for example, by means of the axially longitudinal displacement of the control member 25; whereas, at idle, only the idle-nozzle channel 20 is open and the main-nozzle channel 13 is closed (FIG. 4).

In the range of the rotational speed between idle and full throttle, that is at partial load, half-load all the way to full throttle, a continuous or step-like change of the main-nozzle channel 13 can be provided individually by means of a rotational displacement of the control member 25 (FIGS. 5 and 6) or a closure and opening of additional main nozzles 14 can occur so that an optimal control of the engine 1 is obtained in correspondence to the requirements in dependence upon engine speed.

The connection 29 between the throttle flap 18 and the control member 25 is preferably configured as a mechanical linkage, cable, gear drive or the like. However, it can also be advantageous that the connection 29 be configured electrically or electromechanically, for example, via an electrical positioning motor or an electrical solenoid actuator and/or a rotary magnet.

Figure 6A:
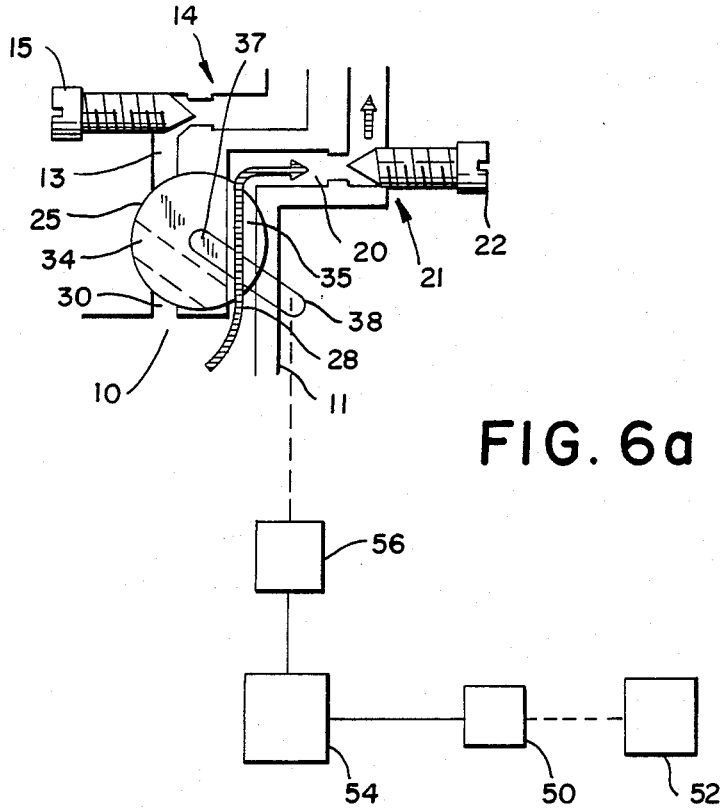
FIG. 6*a* is a schematic diagram showing how the control member of FIG. 6 can be displaced between its two positions by means of a control circuit which detects the rotational speed of the engine.

Moreover, an electronic control can be provided in a preferred embodiment of the invention which detects the instantaneous rotational speed of the engine and supplies an appropriate pulse for the displacement of the control member 25. As shown schematically in FIG. 6a, a sensor 50 detects the speed of the engine 52 and transmits a signal to a control circuit 54 which, in turn, transmits pulses to a positioning motor 56 for actuating the control member 25 between its two positions in dependence upon engine speed.

Figure 8A:
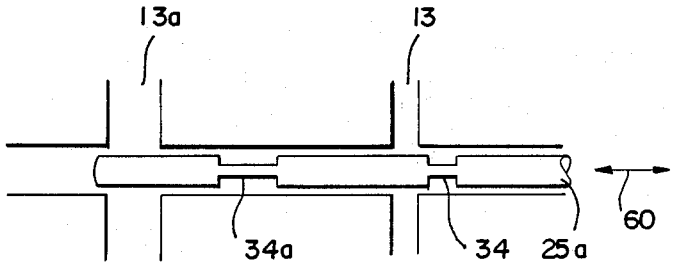
FIG. 8 shows the nozzle control system of FIG. 7, in section, taken along line VIII—VIII in FIG. 7; and, FIG. 8*a* is a schematic of a control member for coacting with two main-nozzle channels having respectively different cross sections.
Figure 7:
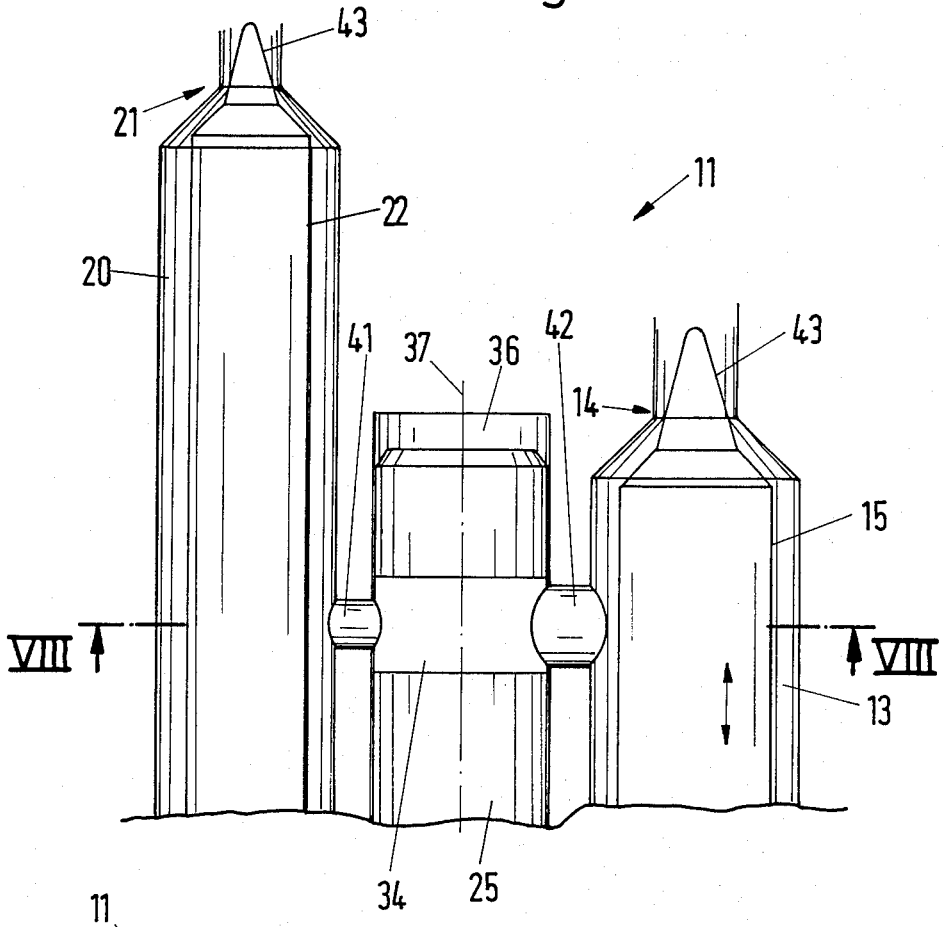
FIG. 7 shows a portion, greatly enlarged, of the carburetor arrangement according to another embodiment of the invention in the region of the nozzle system with a bolt-like or piston-like control member similar to that shown in FIGS. 3 to 6.
Figure 8:
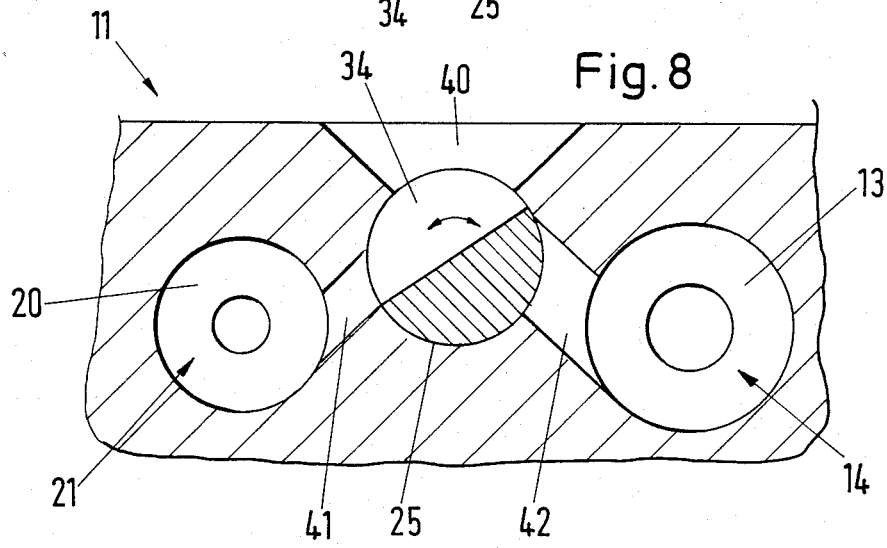

FIGS. 7 and 8 show that the bolt-shaped or piston-shaped control member 25 is arranged in the housing bore 36 of the carburetor 11 so as to be between and parallel to the idle-nozzle channel 20 and the main-nozzle channel 13. The control member 25 can be rotated about its longitudinal axis 37 by approximately 90°. The control member 25 has a slot-like recess 34 formed approximately to the center at its upper end which communicates with the fuel feed 40.

A transverse bore 41 is formed in the housing of the carburetor 11 which extends from the control member 25 to the idle-nozzle channel 20. A further transverse bore 42 extends from the control member 25 to the main-nozzle channel 13 and runs at approximately right angles thereto. The cross section of the transverse bore 42 is greater than that of the transverse bore 41. The mechanical or electrical connection to the throttle flap can be provided at the other end of the control member 25 which is not shown here and by means of which the control member 25 can be rotated proportional to the engine speed in dependence upon the position of the throttle flap. It can also be advantageous to displace the control member 25 in the axial direction (stroke movement).

When the control member 25 in FIG. 8 is in the position shown, the fuel travels the path from the fuel feed 40 through the transverse bore 41 to the idle-nozzle channel 20. The main-nozzle channel 13 is closed in this position of the control member 25. If the control member 25 is rotated approximately 60° to the right, then the idle supply at the left is interrupted and the fuel flows exclusively from the fuel feed 40 through the transverse bore 42 to the main-nozzle system 13.

FIG. 7 shows that the control screw 22 of the idle nozzle 21 and the control screw 15 of the main nozzle 14 have respective conical projections 43 so that the nozzle cross sections can be continuously adjusted by means of an axial displacement. The main-nozzle system can be individually controlled to an optimal power control in correspondence to the engine speed. However, several main nozzles with different cross sections can be switched, opened or closed in a stepwise manner whereby a fine-step control of the engine in dependence upon speed can be obtained. The adjustment of the main nozzle is possible in different ways, for example, by means of a positioning motor by providing a cam (rotational movement) which narrows the cross section of the main nozzle or by means of the arrangement of a slider which narrows or widens the cross section.

FIG. 8*a* shows a control member of the kind shown in FIGS. 3 and 4 provided for coacting with an additional main-nozzle channel 13*a*. The control member 25*a* is movable in the directions indicated by reference numeral 60 and has an additional cutout 34*a*. In FIG. 8*a*, only the main-nozzle channels 13 and 13*a* are shown and have different cross sections. The cutouts are of different widths measured along the longitudinal axis of the control member 25*a* to accommodate respective ones of main-nozzle channels 13 and 13*a*.

A significant advantage of the arrangement according to the invention is that either the idle system or the main-nozzle system can be switched in by means of the adjustment of a control piston 25 in dependence upon the throttle flap and/or the speed. In this way, the nozzle system not needed at that particular time is switched off. Accordingly, in the idle position, no influence occurs from the main-nozzle system (drops from the nozzle). In the load position, while cutting, an influence on the main-nozzle system by the idle system is excluded whereby an optimal efficiency and a precise speed control as well as a limiting of the highest speed is obtained.

It is understood that the foregoing description is that of the preferred embodiments of the invention and that various changes and modifications may be made thereto without departing from the spirit and scope of the invention as defined in the appended claims.

What is claimed is:

1. A membrane carburetor for an internal combustion engine for a handheld apparatus such as a chain saw, the carburetor comprising:

a housing having an interior space and defining an intake passage communicating with the engine and through which a stream of air is drawn by suction when the engine is operating;

a movable regulating membrane mounted in said space so as to define a fuel chamber on one side of said membrane;

feed valve means coacting with said membrane for feeding fuel into said chamber;

an adjustable throttle flap pivotally mounted in said intake passage for movement between an idle position and a load position corresponding to the idle operation and load operation, respectively, of the engine whereby a change in the speed of the engine occurs in correspondence to an adjustment of said throttle flap between said idle and load positions;

idle-nozzle means for metering fuel into said intake passage during the idle operation of the engine; said idle-nozzle means including: an idle-nozzle channel extending from said chamber to said intake passage; and, an idle adjusting screw for adjusting the quantity of fuel supplied to the intake passage through said idle-nozzle channel;

main nozzle means for metering fuel into said intake passage during the load operation of the engine; said main-nozzle means including a main-nozzle channel also extending from said chamber to said intake passage; and, a main adjusting screw for adjusting the quantity of fuel supplied to the intake passage through said main-nozzle channel;

a control member movable between a first position for closing said-nozzle means during said idle operation and a second position for closing said idle-nozzle means during said load operation; said control member being mounted in said housing so as to be disposed between said membrane and said adjusting screws; and, connecting means for operatively connecting said throttle flap to said control member so as to cause the latter to be in said first position when said throttle flap is in said idle position and to move into said second position when said throttle flap is displaced into said load position; and, said connecting means including direct connecting means for directly connecting said control member to said throttle flap thereby making the position to which said control member is moved dependent upon the speed of the engine.

2. The carburetor of claim 1, said control member being a closure flap pivotally mounted in said fuel chamber so as to pivot about an axis between said first and second position and to close off said main-nozzle channel when in said first position and to close off said idle channel when in said second position.

3. The carburetor of claim 1, said direct connecting means being a mechanical coupling interconnecting said throttle flap and said control member.

4. The carburetor of claim 1, said control member being mounted in said fuel chamber.

5. The carburetor of claim 1, said control member being configured as a bolt having cutout means formed therein and defining a longitudinal axis; said bolt being displaceably mounted in said housing so as to be displaceable along said axis between said first and second positions so as to close off said main-nozzle channel when in said first position while at the same time having said cutout means in alignment with said idle-nozzle channel to permit the passage of fuel therethrough and so as to close off said idle-nozzle channel when in said second position while at the same time having said cutout means in alignment with said main-nozzle channel to permit the passage of fuel therethrough; said carburetor further comprising spring means interposed between said housing and said bolt so as to resiliently bias said bolt into one of said positions; and, said connection means including means interconnecting said throttle flap and said bolt for moving said bolt against the force of said spring means when said throttle flap moves in one direction between said idle and load positions.

6. The carburetor of claim 5, said cutout means being dimensioned so as to vary the cross section of said main-nozzle channel as said control member is moved toward said second position thereby adjusting the quantity of fuel metered to the intake passage while said idle-nozzle channel is closed off.

7. The carburetor of claim 5, said main-nozzle means including first and second main-nozzle channels and said cutout means including first and second cutouts formed in said control member for accommodating corresponding ones of said first and second channels; and, said control member being movable to sequentially open and close said first and second main-nozzle channels thereby adjusting the quantity of fuel metered to the intake passage while said idle-nozzle channel is closed off.

8. The carburetor of claim 1, said control member being configured as a bolt having cutout means formed therein and defining a longitudinal bolt axis; said bolt being rotatably mounted in said housing so as to be rotatable about said axis between said first and second positions so as to close off said main-nozzle channel when in said first position while at the same time having said cutout means in alignment with said idle-nozzle channel to permit the passage of fuel therethrough and so as to close off said idle-nozzle channel when in said second position while at the same time having said cutout means in alignment with said main-nozzle channel to permit the passage of fuel therethrough; and, said connection means including means interconnecting said throttle flap and said bolt for rotating said bolt when said throttle flap moves between said idle and load positions.

9. The carburetor of claim 8, said cutout means being dimensioned so as to vary the cross section of said main-nozzle channel as said control member is moved toward said second position thereby adjusting the quantity of fuel metered to the intake passage while said idle-nozzle channel is closed off.

10. The carburetor of claim 8, said main-nozzle means including first and second main-nozzle channels and said cutout means including first and second cutouts formed in said control member for accommodating corresponding ones of said first and second channels; and, said control member being movable to sequentially open and close said first and second main-nozzle channels thereby adjusting the quantity of fuel metered to the intake passage while said idle-nozzle channel is closed off.

* * * * *

UNITED STATES PATENT AND TRADEMARK OFFICE

CERTIFICATE OF CORRECTION

PATENT NO. : 4,861,522

DATED : August 29, 1989

INVENTOR(S) : Reinhard Gerhardy, Hans Holderle, Jürgen Wolf and Werner Vonderau

It is certified that error appears in the above-identified patent and that said Letters Patent is hereby corrected as shown below:

In column 6, line 27: delete "main nozzle" and substitute -- main-nozzle -- therefor.

In column 6, line 35: delete "said-nozzle" and substitute -- said main-nozzle -- therefor.

In column 6, line 55: delete "position" and substitute -- positions -- therefor.

Signed and Sealed this

Seventh Day of August, 1990

*Attest:*

*Attesting Officer*

HARRY F. MANBECK, JR.

*Commissioner of Patents and Trademarks*